United States Patent [19]

Held et al.

[11] 3,998,399

[45] Dec. 21, 1976

[54] WEB CUTTING AND REWIND MACHINE

[75] Inventors: Franz Held, Gross Zimmern; Jorg Glockner, Seeheim; Horst Zimmer, Griesheim, all of Germany

[73] Assignee: Maschinenfabrik Goebel GmbH, Darmstadt, Germany

[22] Filed: Apr. 5, 1976

[21] Appl. No.: 673,362

[30] Foreign Application Priority Data

Apr. 5, 1975 Germany ..... 2514876

[52] U.S. Cl. ..... 242/65; 242/56.2

[51] Int. Cl.[2] ..... B65H 17/08

[58] Field of Search ..... 242/65, 56.2, 56.3, 242/56.6, 56.7

[56] References Cited

UNITED STATES PATENTS 3,086,726 4/1963 Aaron ..... 242/65

3,332,636 7/1967 Rockstrom ..... 242/56.2 X 3,944,152 3/1976 Heymanns ..... 242/65

*Primary Examiner*—Edward J. McCarthy

*Attorney, Agent, or Firm*—Watson, Cole, Grindle & Watson

[57] ABSTRACT

A machine for rewinding a plurality of strips longitudinally cut from a continuous web includes feed drums associated with each roll of the wound strips, and mounting means for the rolls and the drums which are together shiftable along an axis parallel to the drum axis in such a manner as to permit drums of various axial dimensions to be mounted by the drum mounting means so as to accommodate rolls respectively having various axial dimensions. Alternatively, the drum and roll mounting means are disposed for shifting relative to each other along such axis to permit the mounting of both drums and rolls of different axial dimensions.

10 Claims, 5 Drawing Figures

MOTOR
38
15
II
II
23
35
39
55
41
41a
10
36
49
53
52
37
56
29
51
33
42
12
19
25
34
44
45
17
27
28
32
31
48
54
26
24
47
11
22
20
46
21
18
43
16
13
14

66e
34f
66d
66
66c
66b
34e
66a
37e
67
23e
28e
17e
20e
16f
16e

WEB CUTTING AND REWIND MACHINE

BACKGROUND OF THE INVENTION

The present invention relates to a machine for rewinding a plurality of strips cut from a continuous web of paper, foil, or the like, wherein a feed roll is provided for each roll to be wound.

In a machine of this general type, the web is generally cut longitudinally into a number of individual strips which are each rewound into a corresponding roll. The strips may be cut into the same or different widths so that, for example, in one cycle of the machine, relatively wide strips can be cut and rewound while, in the next cycle, relatively narrow strips can be cut and rewound. The machine must therefore be correspondingly reset when changing from one program of production of another. Moreover, when it is desired to cut and rewind both wide and narrow strips during the same cycle, proper adjustment of the machine is required.

In U.S. Pat. No. 3,086,726, a rewind apparatus is disclosed as having a rotatable shaft adapted for the winding thereon of a plurality of rolls of subwebs formed from a web, and feed rolls or riding drums are in peripheral engagment with each of the rolls. Strips can be cut and rewound with this machine so long as they do not exceed a predetermined maximum width, since to do so would require a costly and time-consuming conversion operation.

SUMMARY OF THE INVENTION

The problems of the prior art web cutting and rewind machines are solved by the present invention wherein the mounting means for each roll is capable of being shifted in a direction parallel to the roll axis so as to facilitate the handling of rolls of different axial dimensions during different cycles of the machine. Mounting means at opposite ends of each roll are relatively shiftable, and mounting means at opposite ends of each drum are interconnected with the roll mounting means so as to be shiftable therewith. And, the axial length of each feed roll is greater than the smallest possible width of the strip to be wound with such feed roll.

In another embodiment of the invention, the mounting means for the feed drums are independently shiftable relative to the shiftable roll mounting means so that rolls and drums of different axial dimensions can be accommodated by their respective mounting means. In both embodiments the mounting means for the drums comprise rollers surrounding the drums in peripheral engagement therewith, the rollers being mounted on arm members which are pivotally connected for movement toward and away from one another to facilitate replacement of the drums.

Another feature of the invention includes a resilient cover of adjacent rings on the drums, the number of rings to be used depending on the width of the strip to be rewound.

The mounting means for the drums are shiftable along the entire operating width of the winding machine so as to accommodate drums of different axial dimensions. Also, it is possible with such an arrangement to shift the mounting means for each drum inwardly of one another when a roll of a lesser axial dimension is thereby being wound so that, for another cycle of operation wherein a roll of a greater axial dimension is to be wound, the drum mounting means would not need to be shifted. The transition from one strip width to another is therefore easily effected.

Other features and advantages of the invention will become more apparent from the following detailed description of the invention when taken in conjunction with the accompanying drawings.

DETAILED DESCRIPTION OF THE INVENTION

Figure 1:
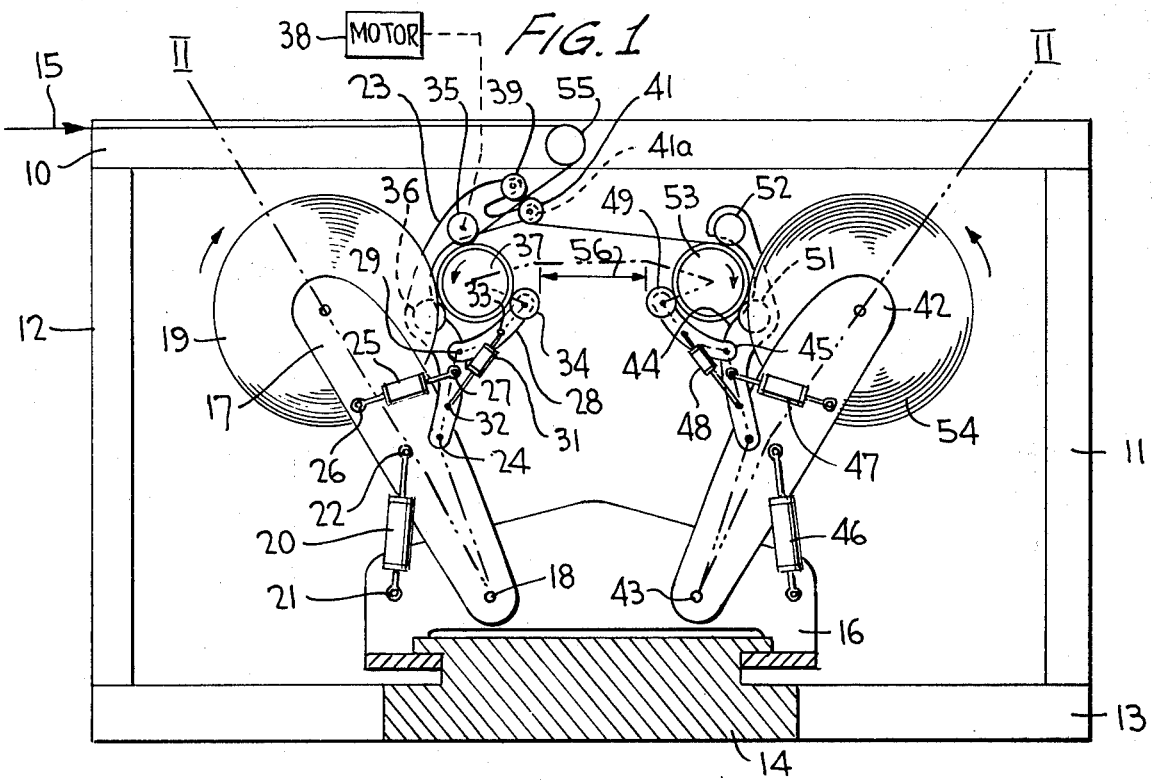
FIG. 1 is a schematic end elevational view of one embodiment of the machine according to the invention.

Turning now to the drawings wherein like reference characters refer to like and corresponding parts throughout the several views, the machine of FIG. 1 comprises interconnected frame members 10, 11, 12 and 13 as well as a transversely extending slide member 14 which may extend along the entire operating width of the machine, or may be at least as long as the maximum width of sheet 15 to be cut into longitudinal strips. Plate members **16, 16*a*, 16*b*, etc., are arranged in pairs and are respectively associated with the rolls to be wound as more clearly shown in FIG. 2. The plates are mounted along slide member 14 and are slidingly engaged therewith in a tongue-and-groove manner as shown in FIG. 1, although the plates and slide member may be slidingly interengaged in some other manner if desired. Pivot arms 17, 17*a*, 17*b*, etc., are pivotally connected at one end thereof to respective plate members 16, 16*a*, 16*b*, etc., as at 18. Rolls 19, 19′, etc., are respectively mounted between pairs of arms 17 by means of their winding shafts 19*a* in any normal manner. Of course, a winding spool may alternatively be mounted between each pair of arms and adapted for the winding thereon of a roll. The angular positions of pivot arms 17 relative to plate members 16 may be adjusted by means of pneumatic cylinders 20 which respectively interconnect the plates and pivot arms as at pivot points 21 and 22,** the cylinders being connected to a pressure source for operation of the pistons thereof in any normal manner.

Figure 2:
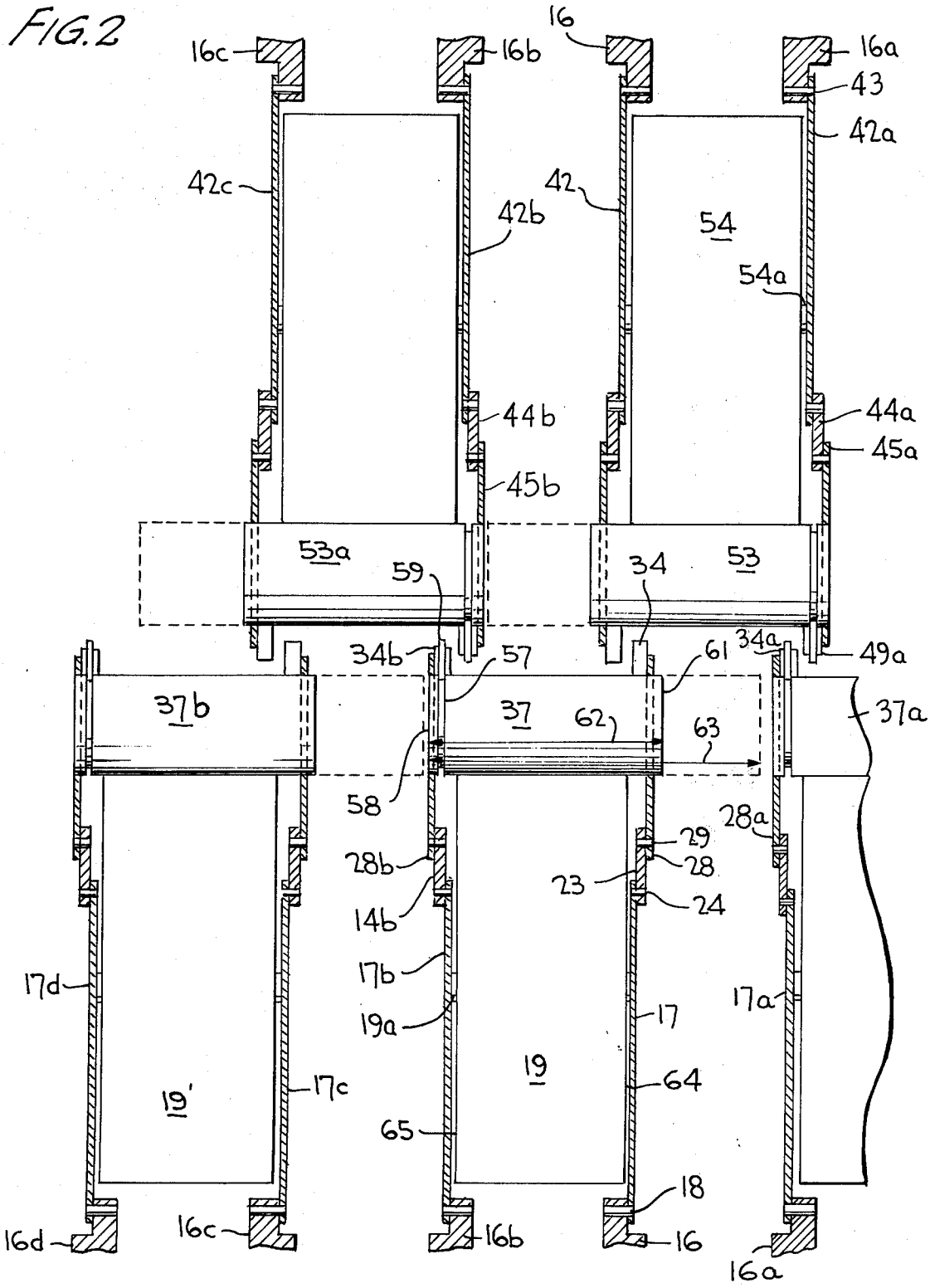
FIG. 2 is a veiw partly in section and showing a plurality of rolls to be wound and taken substantially along the line II—II of FIG. 1.

Arms **23, 23*a*, 23*b*, etc., are respectively pivotally connected as at 24 to pivot arms 17, 17*a*, 17*b*, etc. The angular positions of arms 23 relative to arms 17 are adjustable by means of pneumatic cylinders 25 connected at pivot points 26 and 27 and likewise being typically connected to a pressure source. Rocking levers 28, 28*a*, 28*b*, etc., are respectively connected to arms 23, 23*a*, 23*b*, etc., at pivot points 29, with the angular positions of the rocking levers relative to arms 23 being adjustable by means of pneumatic cylinders 31 pivotally interconnected as at pivot points 32 and 33 and, of course, typically connected with a pressure source for operation of the pistons thereof. Rollers 34, 34*a*, 34*b*, etc., are rotatably mounted at the respective free ends of rocking levers 28, 28*a*, 28*b***, etc., with each such roller being relatively thin in axial dimension as seen in FIG. 2. Also, rollers 35 and 36, of similar size as rollers 34, are rotatably mounted on lever arms 23 with each of the sets of rollers 34, 35 and 36 bearing against the peripheries of cylindrical feed drums 37, 37*a*, 37*b*, etc., One of these rollers, such as roller 35, or the feed drum, can be variably driven by means of a suitable motor 38 in accordance with the rate at which a particular cut strip from web 15 is to be wound. Also disposed on arms 23 are pairs of rotatable circular cutting blades 39 and 41 for the longitudinal cutting of web 15 into strips, as carried out in a well-known manner. Lower cutting blades 41 are mounted on a roll or rolls 41*a* which typically function as in a manner to be hereinafter more fully described. Rollers 34, 35 and 36 are in peripheral engagement with their respective feed drums for mounting them in a position shown in FIG. 1.

Similar to that described above, pivot arms 42, 42*a*, 42*b*, etc., are pivotally connected as at 43 to plates 16, 16*a*, 16*b*, etc., respectively. Arms 44, 44*a*, 44*b*, etc., are pivotally connected to their respective arms 42, and rocking levers 45, 45*a*, 45*b*, etc., are pivotally connected, respectively, to arms 44. Angular adjustment of arms 42, 44 and of rocking levers 45 is effected by means of penumatic cylinders 46, 47 and 48 similarly mounted as described for cylinders 19, 25 and 31. Rollers 49 are rotatably mounted at the free ends of levers 45, and rollers 51 and 52 are rotatably mounted on arms 44. These rollers 49, 51 and 52, in a manner similar to rollers 34, 35 and 36, are in peripheral engagement with feed drums 53 so as to mount them in peripheral engagement with rolls 54 to be wound from the cut strips similarly as described for the left side of the machine when viewing FIG. 1. Winding shafts 54*a* are rotatably mounted between pairs of arms 42, or winding reels having such shafts are so mounted for the winding thereon of rolls 54.

In operation, web 15 is moved in the direction of its arrow in FIG. 1 from a supply roll (not shown) and over a guide roller 55 mounted on frame member 10. The web extends between cutting blades 39 and 41 so as to be thereby cut lengthwise into individual strips, with one of such strips extending partially about drum 37 so as to be wound onto shaft 19*a* into roll 19. An adjacent strip formed by the longitudinal cutting, and lying closer to the observer in FIG. 1, extends about cylinder 41*a* and thereafter partially around feed drum 52 so as to be wound onto shaft 54*a* and into roll 54. In order to provide relatively short and free path lengths for the cut strips, i.e., the path lengths between the points of support of the various strips, distance 56 between rollers 34 and 49 should be designed as short as possible.

As seen in FIG. 2, each feed drum 37, 37*a*, 53, 53*a*, etc., is provided with a peripheral groove 57 near an end 58 of the drums. Rims 59 associated with one of the rollers at this end such as 34 respectively engage grooves 57 for preventing axial shifting movement of the feed drums as the rollers bear thereagainst for radially supporting the feed drums. Alternatively, the rollers may directly engage their respective grooves thereby avoiding the need for rims 59.

No such grooves are, however, provided at opposite ends 61 of the feed drums so that no rims are associated with the bearing rollers at such ends. And, bearings 34, 35 and 36 may be shifted axially of feed drum 37 since the bearings via their levers and arm members are connected to arms 17 which can be shifted along the axial dimension of member 14.

If the width of the cut and wound strips is to be changed between production cycles, arms 17 at opposite ends of roll shafts 19*a* are merely shifted together with their plate members along slide 14 to accommodate the different strip width, and since levers 28 and arms 23 together with bearings 34, 35 and 36 are connected with their respective arm members 17, the mounting means for the feed drums are likewise shifted as arms 17 are so shifted. And, when a roll having an axial dimension less than that shown in FIG. 2 is to be wound, the rims from the bearing rollers remain engaged with their respective grooves during an inward shifting of arms 17. Therefore, the distance between edge 64 of roll 19 and end 61 of feed drum 37 increases when a roll to be wound has an axial dimension less than that shown in FIG. 2. It is therefore possible to effect a rapid change to accommodate th winding of rolls having different axial dimensions as limited by the axial dimension of the feed drum shown in solid outline in FIG. 2. At the same time, each wound strip is assured of having a separate feed drum 37 associated with it. Futhermore, the distances along which the cut strips move through the machine without any support are extremely short by reason of distance 56 being maintained as short as possible.

Although it is possible to shift the mounting means for the roll shafts as described above so as to accommodate rolls of different axial dimensions between operation cycles of the machine, rolls 19 having axial dimensions up to length of the feed drums can only be accommodated. However, the present invention makes provision for changing the feed drums so as to substitute feed drums having axial dimensions greater than that shown at 62 as, for example, a feed drum shown partly in dotted outline in FIG. 2 as having an increased axial dimension 63. A wider range of strip widths can therefore be wound, and the substitution of drums is easily effected by the movement of levers 28 and 49 outwardly of their associated arms 23 and 44 so that feed drums can be removed and replaced by other feed drums of some desired different axial dimension.

Figure 3:
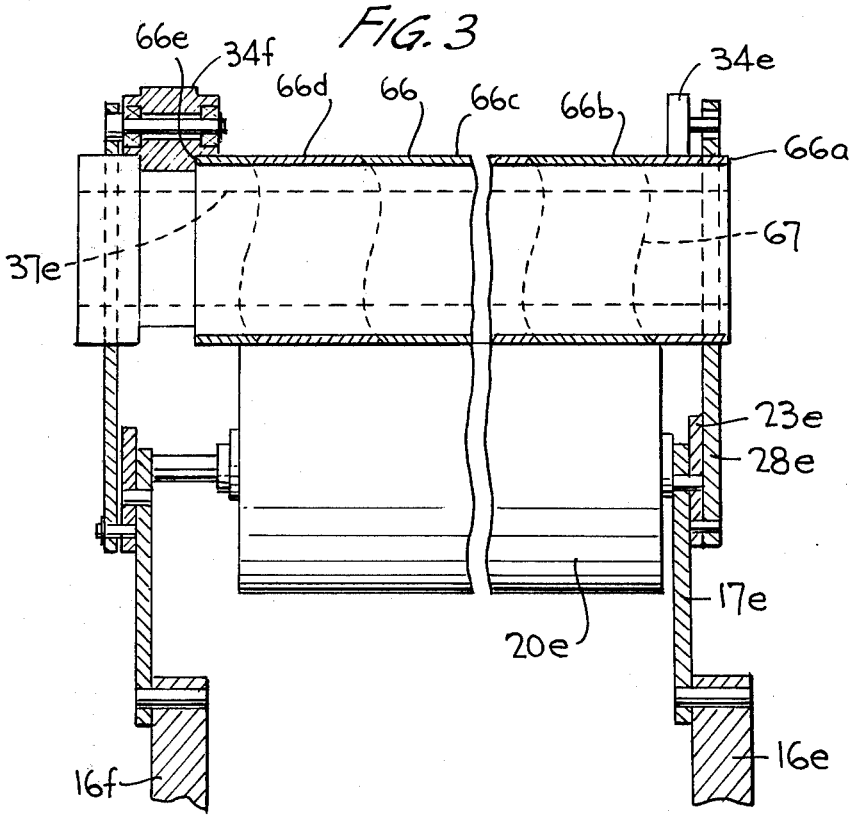
FIG. 3 is a more detailed showing of a feed roll mounted in place.

Except for their particular axial dimension, all the feed drums are identical and may be constructed similarly as shown in FIG. 3. Each drum is substantially tube-shaped and represents a relatively inexpensive part of the machine. It requires no particular time or expense to mount the feed drums of different axial dimensions on the machine. Narrow as well as wide strips can be cut and wound in the same winding machine. Cutting blades 39 and 41 are mounted in the direct vicinity of the feed drums, and cylinder 41*a* permits the cut strips to be appropriately moved through the machine. And, since electric motor 38 which ultimately drives the feed drums can be varied, the appropriate tension of a cut strip can be set. Therefore, the tensions prevailing in web 15, which may be different over the width of the web, are taken into account. With the present arrangement, rollers 34, 35, 36 and 49, 51, 52 are located adjacent opposite edges of the strips to be wound; and these rollers bear against the circumference of their respective feed drums which are in peripheral engagement with their respective rolls 19 and 54.

Each feed drum surface is provided with a cover 66 as typically depicted in FIG. 3 for feed drum 37*a*. Such cover may comprise adjacent abutting sections 66*a*, 66*b*, 66*c*, 66*d* and 66*e*. Each of these sections is substantially ring-shaped and they abut against one another along curved lines 67 or the like so as to insure that the strips which come into contact with the covering during the winding process will not be marked by any ridges possibly appearing between cover sections.

With the use of such a multi-section cover, all or a portion of each feed drum can be covered depending on the number and width of cover sections to be used for a particular strip width. Each cover section is of a resilient material, and the internal diameters thereof are slightly smaller, in a relaxed condition, than the outer diameter of the feed drums. If it is desired to cover over the entire length of a feed drum, rollers 34, 35, 36 and 49, 51, 52 will then bear directly against the cover.

As seen in FIG. 2, both arms 17 and 42*a* for oppositely related rolls are pivotally connected to plate 16, arm 17 being associated with roll 19 and arm 42*a* being associated with roll 54. Therefore, a shifting of plate 16 effects a corresponding shift of arms 17 and 42*a* as well as a corresponding shift of the bearing rollers for oppositely related drums 37 and 53. And, since the cutting blades are likewise mounted on the same arms as are a pair of bearing rollers, cutting of the web into strips of different widths is easily effected so that the machine can be rapidly changed over from one production cycle to another. The necessity for any time-consuming adjustment and positioning of the wound roll and the cutting means is therefore completely eliminated.

Fruthermore, it is possible for each cut strip to run separately onto its associated roll in a manner whereby undesirable stretching of individual strips and a resulting poorer quality of wound rolls is substantially eliminated. In addition, the individual strips to be wound never deviate from the prescribed direction during passage through the machine, so that rolls having even edges are obtained even when the machine operates at high speeds. Moreover, the pressure between a roll and its feed drum may be separately adjusted for each strip and can be maintained during the winding process.

Figure 4:
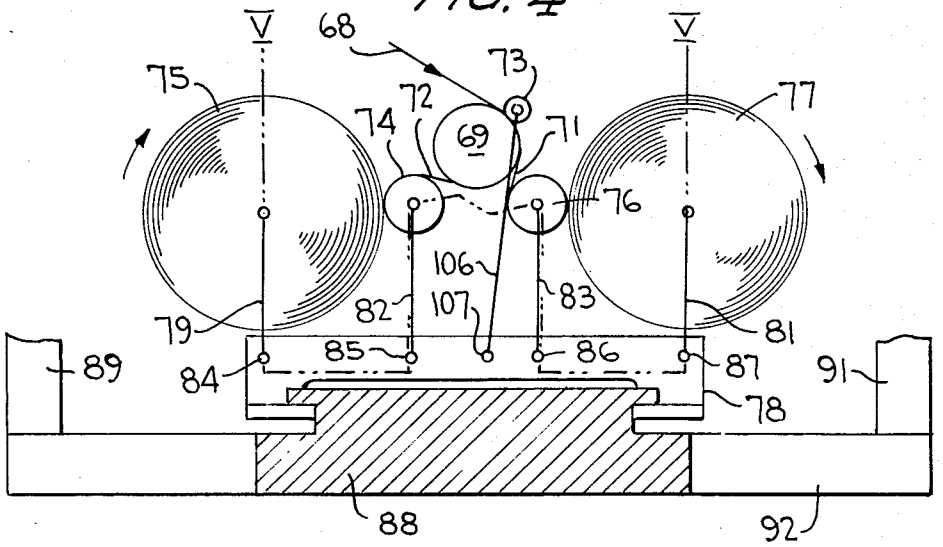
FIG. 4 is a schematic and elevational view of a second embodiment of the machine of the invention and taken substantially along line IV—IV of FIG. 5.
Figure 5:
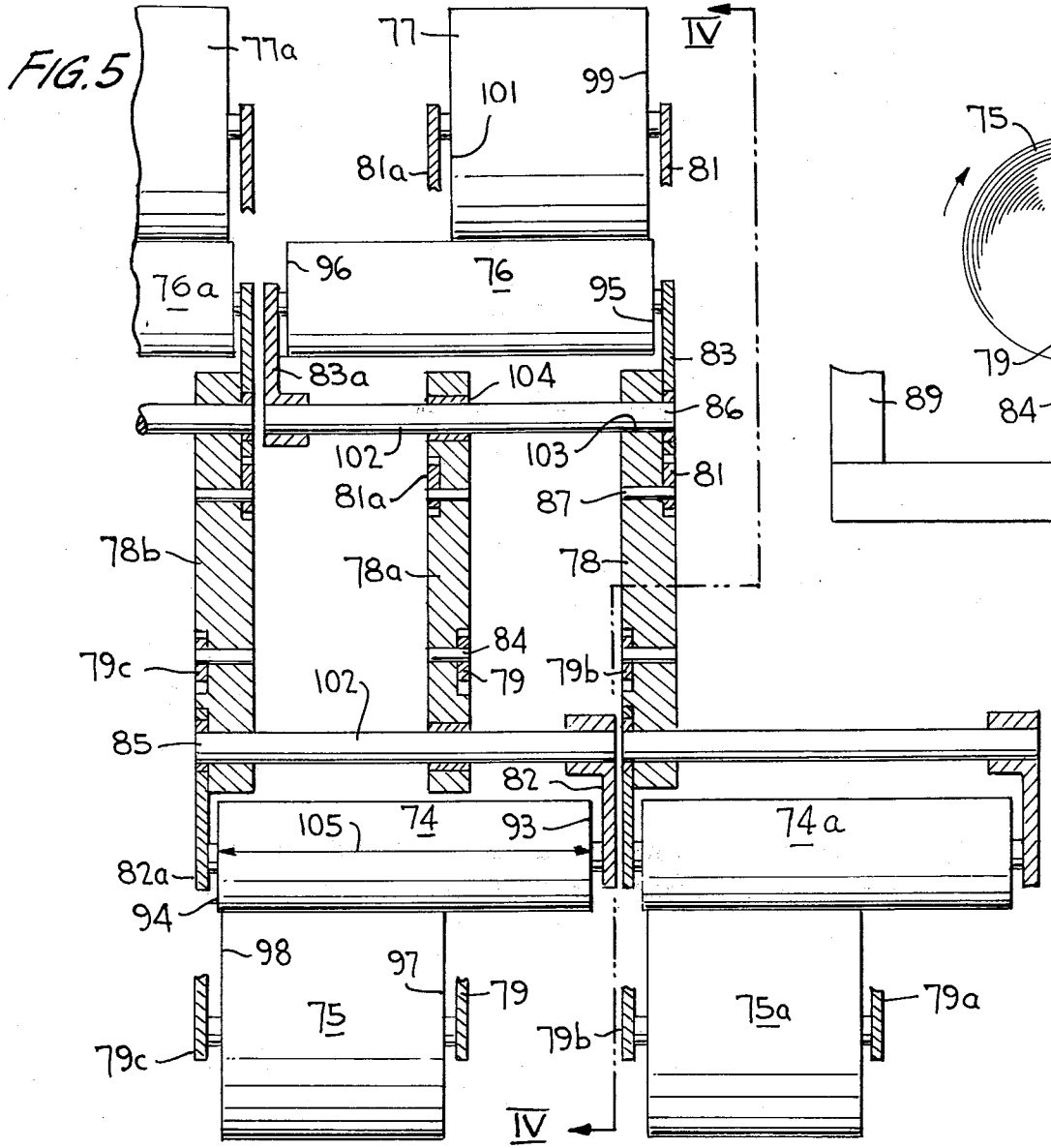
FIG. 5 is a sectional view of the machine taken substantially along the line V—V of FIG. 4.

In another embodiment of the invention shown in FIGS. 4 and 5, a web 68 is moved from a supply roll (not shown) in the direction of its arrow over cylinder 69 rotatably mounted on the machine frame. The web is cut into longitudinal strips 71 and 72 by cutting blades 73 rotatably mounted on the machine and cooperating with cylinder 69 to effect slitting in a well known manner. Strip 72 extends partially around a feed drum 74 and is then wound onto an appropriate roll shaft or reel to form a wound roll 75. And, strip 71 extends partially around a feed drum 76 and is then, in the same manner as strip 72, wound onto a roll shaft or a roll reel so as to form a wound roll 77.

Similarly as in the first embodiment, several wound rolls 75, 75*a*, 75*b*, etc., and 77, 77*a*, 77*b*, etc., can be arranged one behind the other as shown in FIG. 5. Each individual roll has a feed drum 74, 74*a*, 74*b*, etc., 76, 76*a*, 76*b*, etc., respectively associated with it in peripheral engagement. The roll shafts and the feed drums are pivotally connected to corresponding plates 78, 78*a*, 78*b*, etc., by means of arms 79 and 81 and arms 82, 83 having respective points 84, 85, 86 and 87 of pivotal connection. Each plate 78 can be shifted and locked in position on a slide member 88 which extends parallel to the roll axes over a length at least equal to the width of the rolls to be wound.

As seen in FIG. 5, the reference numerals of arms 79, 81 and 82, 83 have subscripts which identify the arms which are connected to the particular plate members 79, 79*a*, 79*b*, etc. And, it can be seen that arms 82 and 82*a* are respectively located adjacent opposite ends 93 and 94 of each feed drum 74 and are thus adjacent the edges of the strips to be wound. Similarly, arms 83 and 83*a* are respectively located adjacent opposite ends 95 and 96 of each feed drum 76. Pivot arms 79 and 79*c* are respectively located adjacent opposite ends 97 and 98 of roll 75, and arms 81 and 81*a* are respectively located adjacent opposite ends 99 and 101 of roll 77. Arms 79 and 82, together with their corresponding plate 78, therefore provide a support for a particular roll or feed drum.

Another slide in the form of rods 102 extend toward one another from plates 78 and 78*b* and are respectively secured thereto within bores 103 by means of a force fit, or the like. These rods respectively form pivot joints s85 and 86 about which arms 82 and 83 are pivotable. Plate 78*a* likewise has bores for bearings 104 through which rods 102 extend, plate 78*a* therefore being shiftable along the rods. Arms 83*a* and 82 are connected to their respective rods 102 also for shifting movement therealong and may be locked in place (not shown) if desired. Accordingly, feed drums 76 of different axial dimensions can be mounted in the machine along the same corresponding guide 102, and can be pivoted about joint 86 and 85 defined by rods 102.

Since plate 78 is located adjacent end 99 of roll 77, and end 95 of drum 76 can be shifted within the limits of the length of rod 102 independently of plate 78*a* adjacent opposite end 101 of roll 77, it is possible to wind rolls 77 of different axial dimensions. It is also possible to wind rolls 75 of different axial dimensions for te same reasons and in the same manner as that described for rolls 77. The changeover of the machine from one width of roll 77 or 75 to be wound to another is quite simple, since only plates 78, 78*a*, etc., need be shifted relative to one another. When arms 83 and 83*a*, as well as rod 102, are arranged as shown and described, then feed drums 74, 76 of different axial dimensions 105 can likewise be effortlessly mounted in the machine, so that rolls 75 and 77 can be wound into different axial dimensions with feed drums of corresponding dimensions.

The means for mounting the rolls and feed drums in the FIG. 4 embodiment are similar to that described in detail for FIG. 1.

Obviously, many modifications and variations of the present invention are made possible in the light of the above teachings. For example, means other than rims can be used for preventing axial shifting movement of the feed drums, and any longitudinal cutting device can be used without departing from the invention. Also, arms 23 of the first embodiment can be pivotally connected directly to plate 16 rather than to arms 17, and the cutting blades may be likewise mounted on plates 16. Also, since guide 4oll 55 is disposed above the rewind means of the machine, it is possible to thereby guide web 15 to separate cutting devices, winders, etc., from above. Thus, the web easily accessible for operating processes so that, for example, it can be easily inserted into the machine before the beginning of the winding process.

It is therefore to be understood that within the scope of the appended claims, the invention may be practiced otherwise than as specifically described.

What is claimed is:

1. A machine for rewinding a plurality of strips longitudinally cut from a continuous web, comprising: roll means; at least two rewind elements on which said strips can be respectively wound into rolls of predetermined axial dimensions; a pair of feed drums, each of a predetermined axial dimension, in peripheral engagement with said rolls; said roll means, rewind elements and feed drums being positioned for permitting a pair of said strips to pass through said roll means, over a respective feed roll and onto a respective element to form rolls; mounting means adjacent opposite ends of each of said elements along a direction parallel to the axes of said feed drums; and means for mounting said drums being respectively connected to said element mounting means; whereby strips can be wound into rolls of axial dimensions less than said predetermined dimensions upon a shifting together of said mounting means to lie adjacent the opposite ends thereof.

2. The machine according to claim 1, wherein said drum mounting means include rollers surrounding said drums and bearing against the periphery thereof, and means for preventing axial shifting of said drums relative to said rollers.

3. The machine according to claim 2, wherein said axial shifting preventing means comprise a peripheral groove on one end of each said drums and rims on said bearings in engagement with said grooves.

4. The machine according to claim 2, wherein said drum mounting means further include arm members interconnected together and to said element mounting means, said bearings being rotatably mounted on said arm members.

5. The machine according to claim 2, wherein said arm members are pivotally interconnected together and to said element mounting means, and said drum mounting means still further include means for adjusting the relationship between said arm members as well as between said element mounting means and said arm members, whereby said arm members may be moved outwardly of one another to facilitate replacement of the drums of axial dimensions greater than said predetermined drum axial dimensions upon shifting said mounting means relatively outwardly.

6. The machine according to claim 1, wherein each said drum is covered by abutting cover sections having a combined width corresponding to the width of the strip to be wound.

7. The machine according to claim 1, wherein said element mounting means include arm members pivotally connected to a base member, and a slide member being provided in sliding engagement with said base member, said slide member extending parallel to said axes.

8. A machine for rewinding a plurality of strips longitudinally cut from a continuous web, comprising: roll means; at least two rewind elements on which said strips can be respectively wound into rolls of predetermined axial dimensions; a pair of feed drums, each of a predetermined dimension, in peripheral engagement with said rolls; said roll means and said elements being mounted for rotation with said drums being resepctively positioned between said roll means and said elements; mounting means at opposite ends of each of said elements being independently shiftable relative to said elements along a direction parallel to the axes of said drums; and mounting means at opposite ends of each of said drums being independently shiftable relative to said drums and relative to said element mounting means; whereby drums of axial dimensions different from said predetermined axial dimension may be mounted by said drum mounting means upon shifting thereof, and whereby rolls of axial dimensions different from said predetermined axial dimension may be mounted by said element mounting means upon shifting thereof.

9. The machine according to claim 8, wherein a slide member extends parallel to said axes, three mutually spaced plate members at least one of which being in sliding engagement with said slide member, and a pair of elongated slide guides extending parallel to said slide member, said element mounting means being connected with pairs of said plate members including said slideable plate, and said drum mounting means being connected with said guides, whereby said element and said drum mounting means are shiftable along said member independently of one another.

10. The machine according to claim 9, wherein said slideable plate member is located between the remaining plate members, and said guides extend from said remaining plate members toward one other and through said slideable plate member.

* * * * *